US011466818B2

(12) United States Patent
Yan et al.

(10) Patent No.: US 11,466,818 B2
(45) Date of Patent: Oct. 11, 2022

(54) LIGHTING UNIT SUCH AS A BULB

(71) Applicant: SIGNIFY HOLDING B.V., Eindhoven (NL)

(72) Inventors: Chengrui Yan, Shanghai (CN); Mo Shen, Shanghai (CN); Xiaoqing Duan, Shanghai (CN); Yuanqiang Liu, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/498,819

(22) Filed: Oct. 12, 2021

(65) Prior Publication Data

US 2022/0120387 A1 Apr. 21, 2022

(30) Foreign Application Priority Data

Dec. 22, 2020 (EP) ..... 20216336

(51) Int. Cl.

| | |
|---|---|
| ***H05B 45/20*** | (2020.01) |
| ***H05B 45/10*** | (2020.01) |
| ***F21V 23/04*** | (2006.01) |
| ***F21V 23/06*** | (2006.01) |
| ***F21K 9/235*** | (2016.01) |
| *F21Y 115/10* | (2016.01) |

(52) U.S. Cl.

CPC ..... *F21K 9/235* (2016.08); *F21V 23/04* (2013.01); *F21V 23/06* (2013.01); *H05B 45/10* (2020.01); *H05B 45/20* (2020.01); *F21Y 2115/10* (2016.08)

(58) Field of Classification Search

CPC ..... F21K 9/235; F21K 9/238; F21K 9/275; F21V 23/04; F21V 23/06; F21Y 2115/10; H01J 5/50; H01J 5/54

See application file for complete search history.

(56) References Cited

U.S. PATENT DOCUMENTS

| | | | | |
|---|---|---|---|---|
| 1,551,463 | A | 8/1925 | Brown | |
| 3,260,888 | A * | 7/1966 | Webb, Jr. | H01K 1/64 313/272 |
| 2013/0182426 | A1 | 7/2013 | Xu | |
| 2014/0049963 | A1 | 2/2014 | McGuire et al. | |
| 2018/0092183 | A1 | 3/2018 | Halliwell | |
| 2018/0116029 | A1 | 4/2018 | Pyshos et al. | |
| 2018/0206305 | A1 | 7/2018 | Van Winkle | |
| 2018/0227991 | A1* | 8/2018 | Hegde | F21V 23/005 |
| 2020/0263838 | A1 | 8/2020 | Pyshos | |
| 2021/0410243 | A1* | 12/2021 | Lan | F21V 23/04 |

FOREIGN PATENT DOCUMENTS

| | | |
|---|---|---|
| CN | 205331864 U | 6/2016 |
| CN | 210950838 U | 7/2020 |

* cited by examiner

*Primary Examiner* — Anabel Ton
(74) *Attorney, Agent, or Firm* — Daniel J. Piotrowski

(57) ABSTRACT

The invention provides a lighting unit having an internal controller. The external power connector of the lighting unit (i.e. the electrical connector plug for connecting the lighting unit to an electrical lighting socket) comprises a manual adjustment element for selecting a setting of the controller. Thus, the manual adjustment element, which functions as a manual user interface, is integrated into the electrical plug part of the lighting unit.

15 Claims, 7 Drawing Sheets

LIGHTING UNIT SUCH AS A BULB

CROSS-REFERENCE TO PRIOR APPLICATIONS

This application claims the benefits of Chinese Patent Application No. PCT/CN2020/121262, filed on Oct. 15, 2020 and European Patent Application No. 20216336, filed on Dec. 22, 2020. These applications hereby incorporated by reference herein.

FIELD OF THE INVENTION

The invention relates to lighting units, and in particular it concerns lighting units with built-in controllers, with adjustable settings such as adjustable color temperature.

BACKGROUND OF THE INVENTION

LED bulbs (by which is meant any enclosed lighting unit) typically include a built-in driver, so that the bulb can be fitted to a conventional mains lighting socket. LEDs give the opportunity for various different lighting characteristics or effects, to be implemented by the built-in driver.

One lighting characteristic of particular interest is the color temperature, e.g. cool white or warm white. However, the built-in driver may enable other characteristics to be set.

To enable adjustment of the driver settings, communication is needed with the driver of the bulb. This may be achieved by providing a lighting system with communication between all of the lighting unit and with centralized or distributed control.

However, it would be desirable to enable the driver settings to be adjusted for an individual lighting unit, without the lighting unit forming part of a network. The problem then arises that there is no space for a user input interface on the bulb. The exposed part of a bulb is typically glass, with no easy way to implement a user interface in a low cost manner. It is also difficult to find space for a user interface without increasing the size of the bulb.

SUMMARY OF THE INVENTION

According to examples in accordance with an aspect of the invention, there is provided a lighting unit comprising:

an outer housing;

a light source within the outer housing;

a controller within the outer housing for controlling the light source; and an external connector interface for connecting the lighting unit to an external source of power, wherein the external connector interface comprises a manual adjustment element, wherein the manual adjustment element is for selecting a setting of the controller and wherein the manual adjustment element is inaccessible when the lighting unit is connected to the external source of power.

This lighting unit has an adjustment element provided at the external power connector of the unit. The adjustment element is not accessible (i.e. it is hidden and covered up) after the lighting unit is connected to external power. It is used for pre-setting a mode of operation before the lighting unit is fitted to the external source of power. This may for example enable a single lighting unit to have different possible functions, such as light output characteristics, which the end user can pre-select. The use of the external connector interface means no space is taken up from the outer design of the lighting unit, since the external connector interface is a required part of the lighting unit and it is not visible in use. The external connector interface may comprise at least one connector pin, wherein the connector pin is rotatable and functions as the manual adjustment element.

The lighting unit for example comprises a bulb or a tubular lamp.

Any bulb type may be modified to provide the adjustment feature by incorporating an adjustment element at the connector interface where the bulb connects to external power.

By using a connector pin as the manual adjustment element, no additional space is a taken up. The rotational position of the connector pin does not alter its other function of providing an electrical power connection to a socket of the source of external power.

The connector pin is for example rotatable between at least two positions corresponding to different settings of the controller.

There may be only two settings (such as cool white or warm white) or there may be more than two settings.

The external connector interface may comprise a screw connector having the at least one connector pin as a central connector terminal and having a surrounding thread connector.

The adjustment element is then integrated into a screw cap fitting such as an E17 or E27 fitting.

A metal intermediate part which electrically contacts a power supply terminal of the controller may be provided. The metal intermediate part electrically contacts a power supply terminal of the controller and the connector pin mechanically couples to a switch of the controller for selecting the setting of the controller. In one example, the metal intermediate part is a metal intermediate ring in which the connector pin is rotatably received, in another example, the metal intermediate part is a leaf spring with which the connector pin (22) is rotatably contacted.

This intermediate part provides separation of the power transfer function and the adjustment function of the connector pin.

The switch of the controller may comprise a rotary adjustment knob which is engaged by a rear part of the connector pin. The rotary adjustment knob is for example a discrete surface mount component for attachment to a printed circuit board.

The connector pin may have a screw driver slot on a front part which is exposed to the outside of the lighting unit. This enables easy adjustment by an end user but does not detract from the function of the central connector pin in making electrical contact to an external socket.

The lighting unit may comprise a plastic over-molded ring between the connector pin and the thread connector, wherein the metal intermediate ring is fixed in position by the over-molded ring.

This enables a simple manufacturing process for fitting the intermediate ring, which itself holds the central connector pin.

The setting of the controller may comprise a white color temperature setting. Users frequently wish to choose between warm white and cool (natural) white settings.

The setting of the controller may instead (or additionally) comprise a brightness setting or a color setting. Thus, there are different possible controller features that may be selected.

The setting of the controller may additionally or alternatively comprise a beam shape setting. This is possible if the lighting unit has electronic means for beam shaping control.

The light source preferably comprises an LED arrangement and the controller comprises a LED driver.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
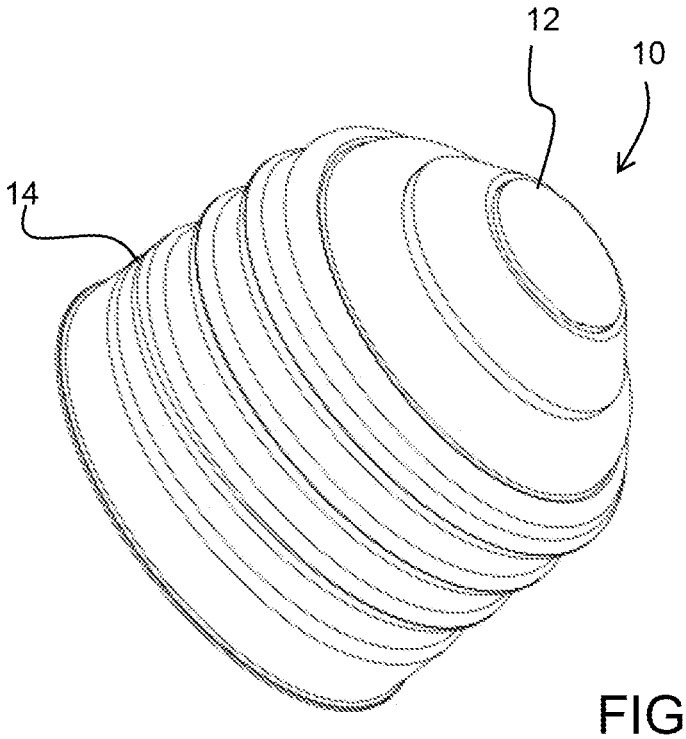
FIG. 1 shows a typical screw type bulb cap.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a lighting unit having an internal controller. The external power connector of the lighting unit (i.e. the electrical connector plug for connecting the lighting unit to an electrical lighting socket) comprises a manual adjustment element for selecting a setting of the controller. Thus, the manual adjustment element, which functions as a manual user interface, is integrated into the electrical plug part of the lighting unit.

FIG. 1 shows a typical screw type bulb cap 10, such as an E17 or E27 cap, having a central connector pin 12 and a surrounding thread connector 14.

In one set of examples, the manual adjustment element of the invention is integrated into this type of bulb cap.

Figure 2:
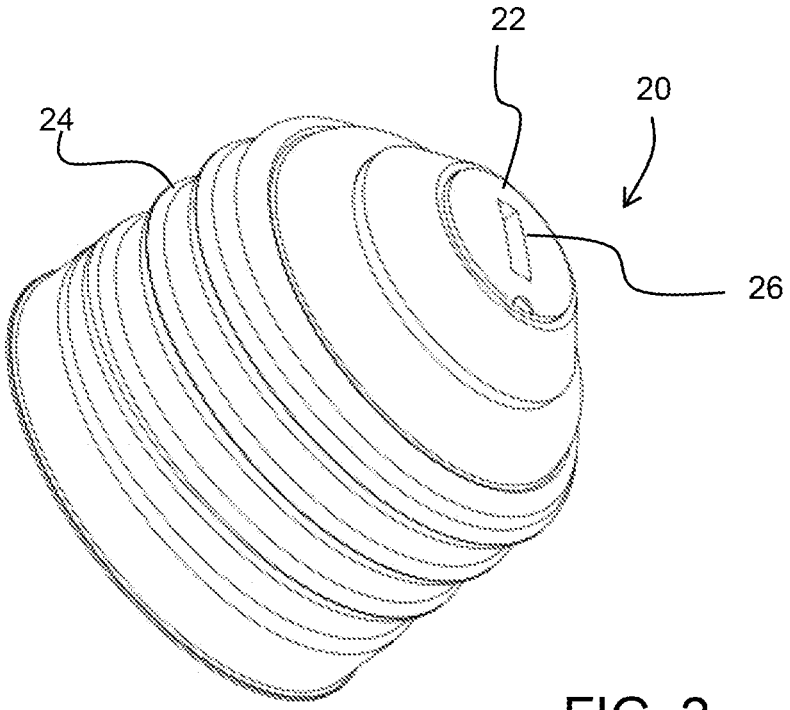
FIG. 2 shows a screw type bulb cap in accordance with one example of the invention.

FIG. 2 shows a screw type bulb cap 20, again such as an E17 or E27 fitting, in which the central connector pin 22 is modified in accordance with this example of the invention. The surrounding thread connector 24 is also shown. The central connector pin 22 has a screw driver slot 26 on a front part which is exposed to the outside of the bulb cap (and hence the outside of the overall lighting unit which includes the bulb cap). The central connector pin thus functions as a manual adjustment element. The screw driver slot enables easy adjustment by an end user but does not detract from the function of the metal pin in making electrical contact to an external socket.

As explained below, the rotary adjustment is used to control a setting of an integrated driver.

Figure 3:
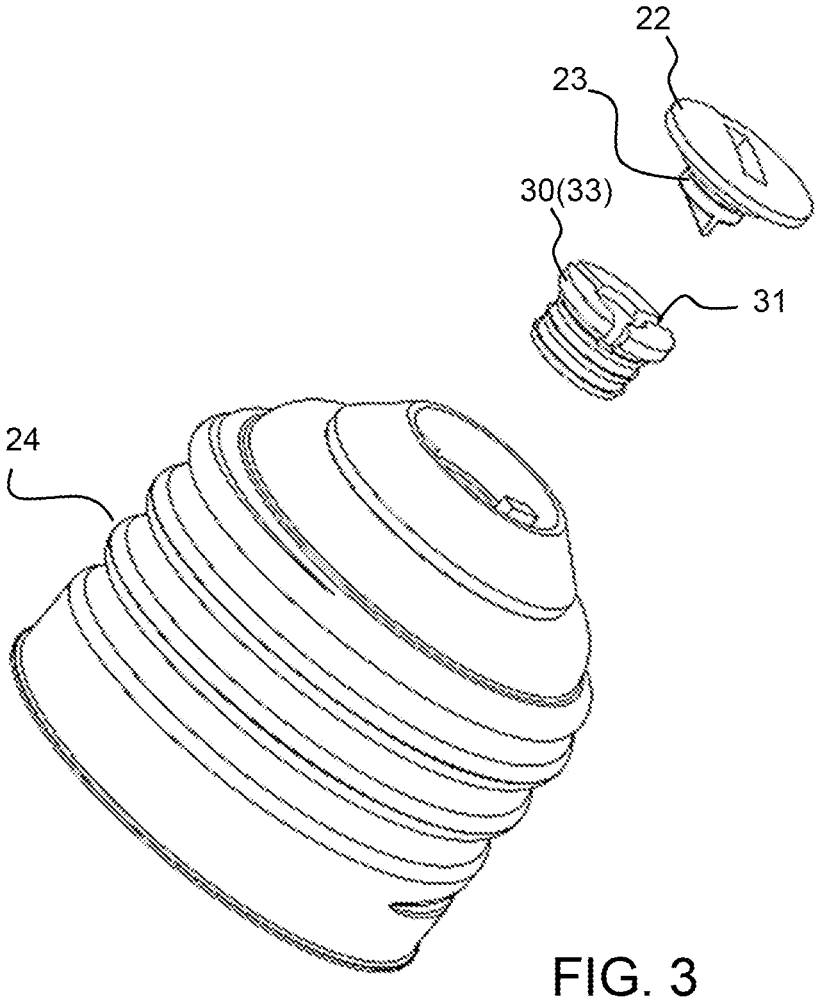
FIG. 3 shows an exploded view of the bulb cap of FIG. 2.

FIG. 3 shows an exploded view of the bulb cap.

The bulb cap has a metal intermediate part 30 (in this example, a ring 33) in which the connector pin 22 is rotatably received. The metal intermediate ring 33 electrically contacts a power supply terminal within the lighting unit and a back face of the connector pin 22 mechanically couples to a switch of a built-in controller for selecting a setting of the controller. The intermediate ring 33 provides separation of the power transfer function and the adjustment function of the connector pin.

Figure 4:
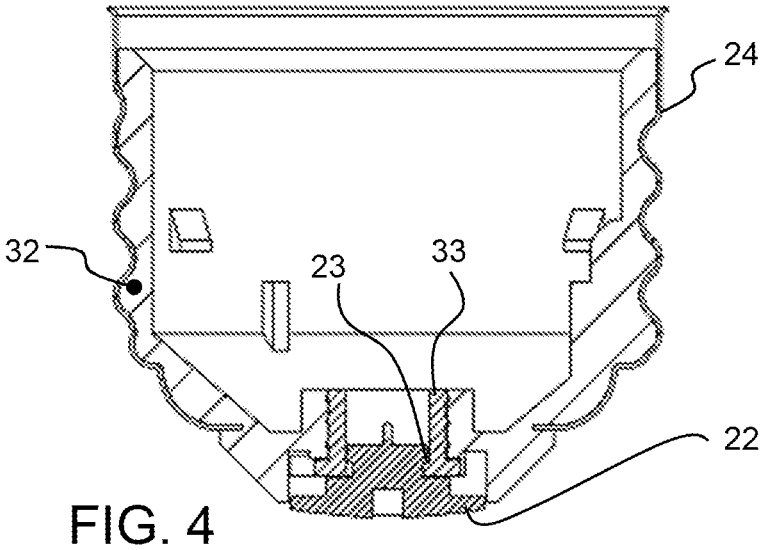
FIG. 4 shows the assembled bulb cap in cross section.

FIG. 4 shows the assembled cap in cross section. The intermediate ring 33 is mounted on the back of the connector pin 22, and a plastic over-molded ring 32 is provided between the connector pin 22 and the thread connector 24. The metal intermediate ring 33 is fixed in position by the over-molded ring 32. The over molding thus fixes the relative positions of the metal intermediate ring 33 and the thread connector 24, but the connector pin 22 is free to rotate within the intermediate ring.

As shown in in FIG. 3, there are several slots 31 on the top part of the intermediate ring 33 extending radially outwardly from a central opening. These slots 31 provide a certain elasticity of the top part of the intermediate ring 33, such that a connector pin 22 with an enlarged (mushroom) head 23 at the end of a narrower neck can be inserted through the central opening and held in the axial directional position by the central opening of the ring 33, while still being rotatable. The enlarged head 23 passes through the central opening, which expands to allow the head to pass, and central opening then contracts around the neck.

Figure 5:
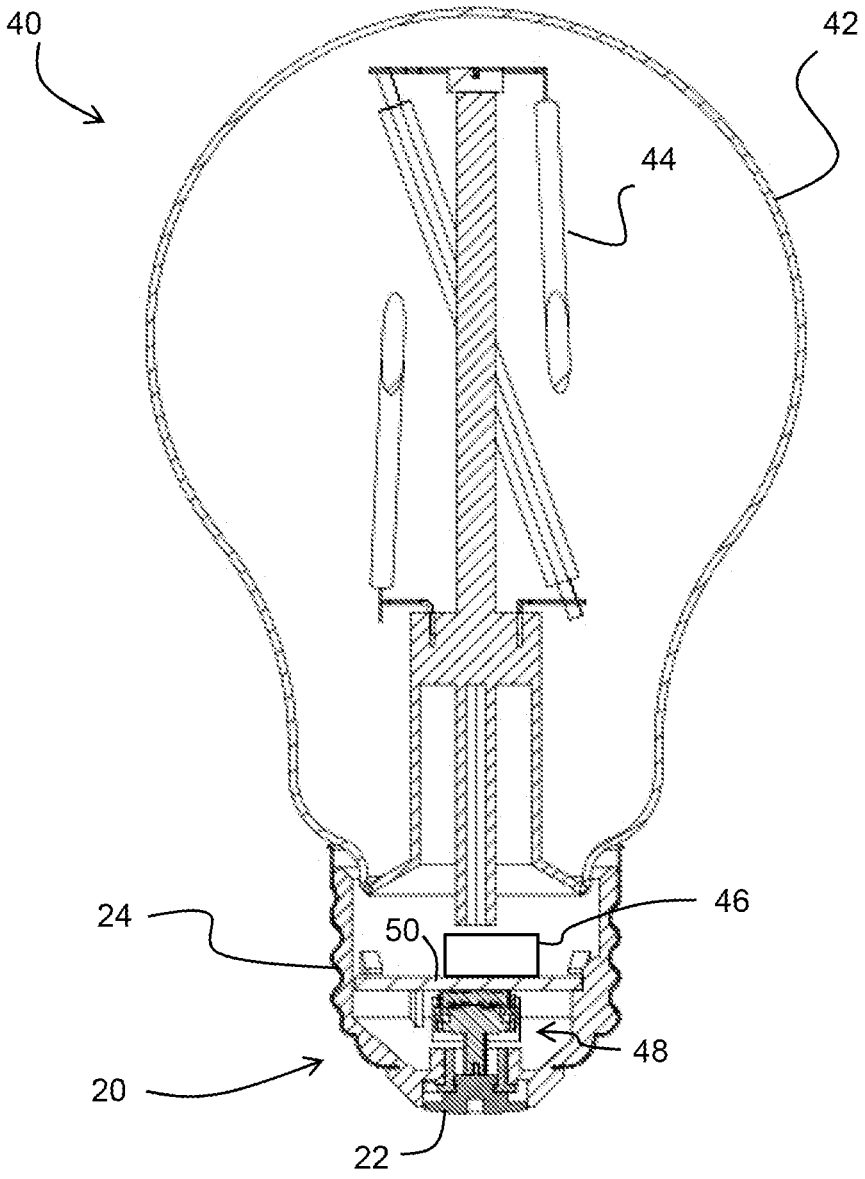
FIG. 5 shows a lighting unit using the bulb cap of FIGS. 2 to 4.

FIG. 5 shows a lighting unit 40, in this example a bulb, using the end cap of FIGS. 2 to 4.

The lighting unit 40 has an outer housing 42, in particular a glass enclosure, which is attached to the bulb cap 20. A light source 44, such as a filament LED, or any other type of LED arrangement, is within the outer housing 42.

The built-in controller 46 is also within the outer housing 42 and/or the cavity of cap 20 for controlling the light source 44. The controller 46 comprises a LED driver.

Figure 6:
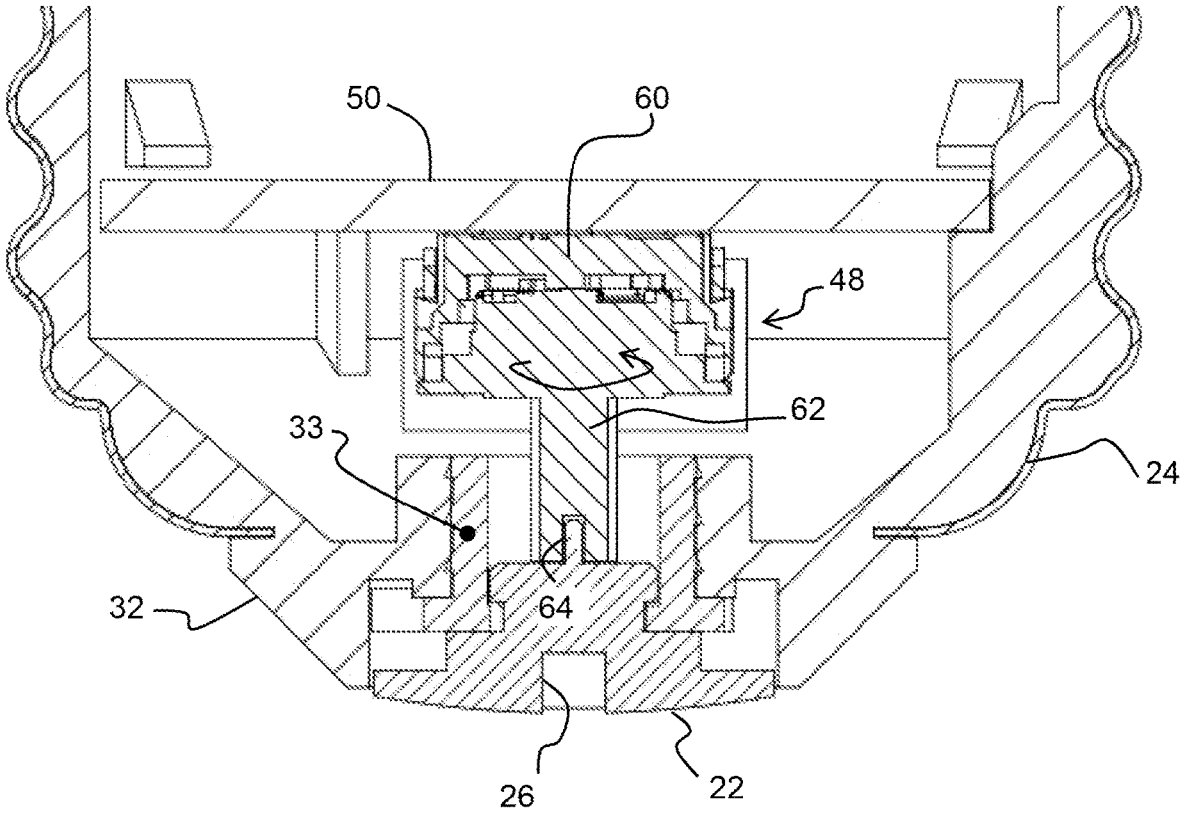
FIG. 6 shows an enlarged view of the bulb cap area of the lighting unit of FIG. 5.

The back of the manual adjustment element, i.e. the connector pin 22 in this example, interfaces with a rotary adjustment knob 48. The rotary adjustment knob 48 is for example a surface mount component on a PCB 50. This PCB may be a same PCB which carries the circuits of the controller 46. It may be a single sided PCB or a double sided PCB, and the rotary adjustment knob may be on the same side or the opposite to the controller (i.e. LED driver) components. The rotary adjustment knob may have an integrated shaft extending outwardly from the PCB, the end of which is engaged by the back of the connector pin 22 (as shown in FIGS. 5 and 6) or the rotary adjustment knob may be a low profile component with a recess which is engaged by a shaft which extends from the back of the connector pin 22.

The manual adjustment element, i.e., the connector pin 22 in this example, of the bulb cap is for selecting a setting of the controller 46. The adjustment element is thus provided at the external power connector of the lighting unit. Thus, the adjustment element is not accessible after the lighting unit is connected to external power, and thereby it takes up no external space of the lighting unit once in use. The lighting unit thus does not need to increase in size to accommodate the adjustment function.

The adjustment is used for pre-setting a mode of operation before the lighting unit 40 is fitted to the external source of power. This may for example enable a single lighting unit to have different possible functions, such as light output characteristics, which the end user can pre-select.

There may be two or more settings. Two settings could for example be a cool white or warm white setting. However, other setting may also be adjusted, such as a brightness setting or a color (rather than color temperature) setting. Thus, there are different possible controller features that may be selected. It is also known to provide an electronically controlled beam shape, for example by providing multiple LEDs with different optical output beam shape characteristics, and selecting which LEDs to activate. Thus, the setting may enable selection between a narrow beam (e.g. task light) and a wide beam (e.g. general illumination).

FIG. 6 shows an enlarged view of the bulb cap area of the lighting unit of FIG. 5.

In this example, the rotary adjustment knob 48 comprises a fixed part 60 which is attached to the PCB 50 and a coupled projecting rotary shaft 62. The back of the coupling pin 22 has a projection 64 for engaging with the end of the rotary shaft 62.

Figure 7:
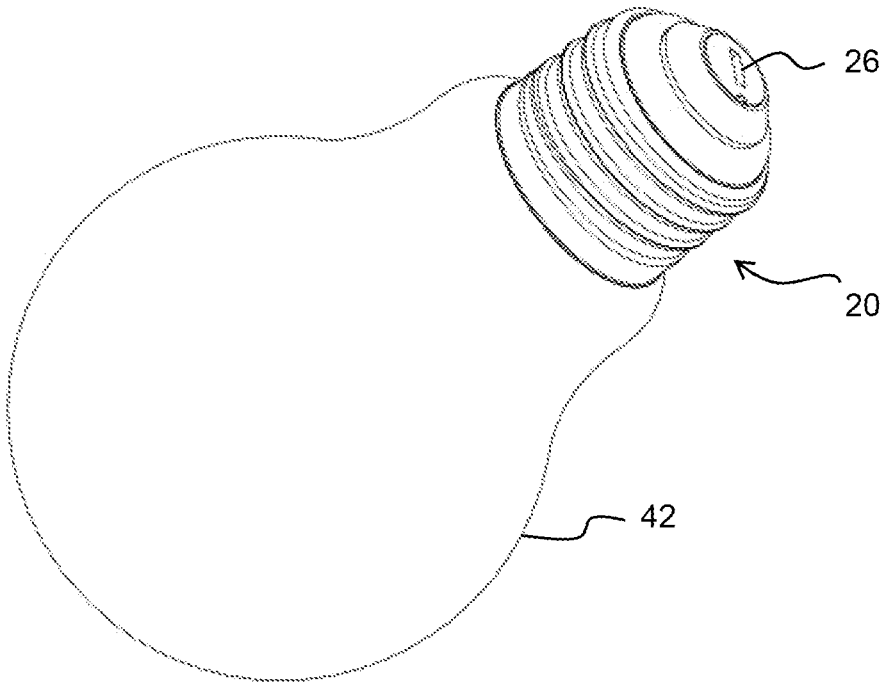
FIG. 7 shows the lighting unit of FIG. 5 in perspective view.

FIG. 7 shows the lighting unit in perspective view.

The metal intermediate part 30 may be in the form of a leaf spring 35 as below two examples shown in FIGS. 10-13.

Figure 10:
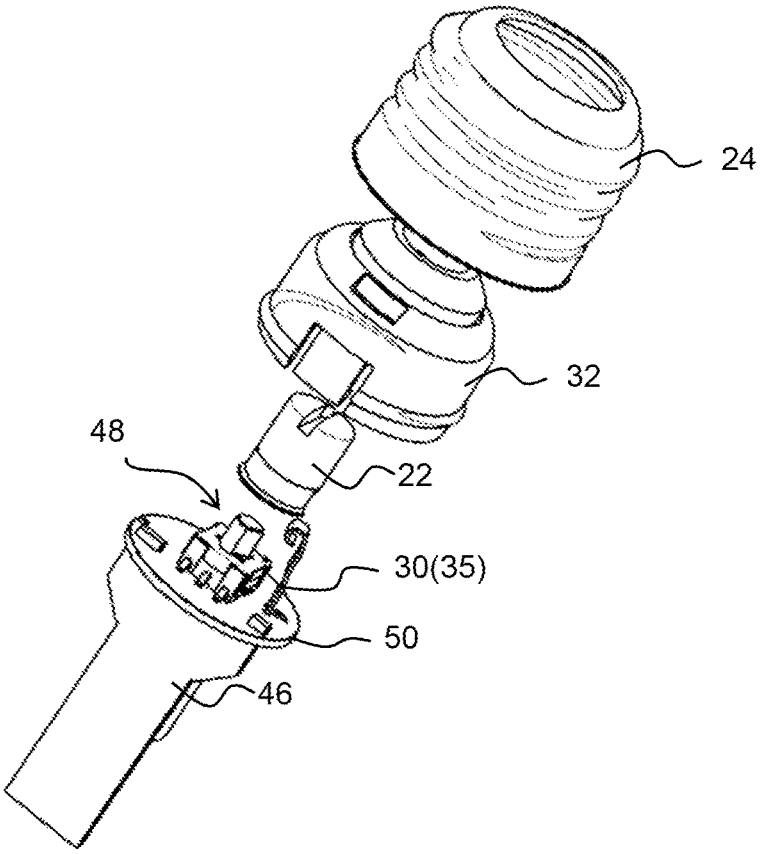
FIG. 10 shows an exploded view of a screw type bulb cap (together with the driver portion) in accordance with another example of the invention.
Figure 11:
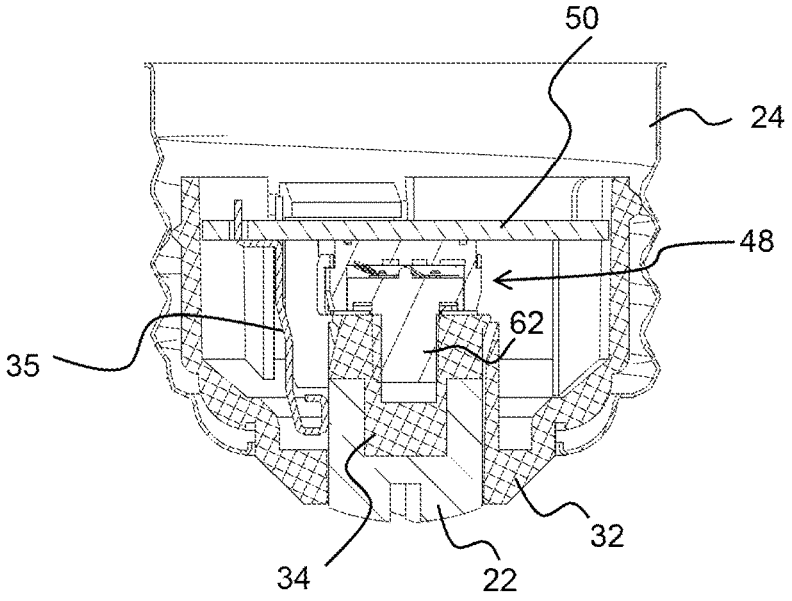
FIG. 11 shows a sectional view of the bulb cap of FIG. 10.

In the example shown in FIG. 10 and FIG. 11, the leaf spring 35 is soldered on the PCB 50 and connected to a power supplier terminal of the controller 46. In this example the PCB 50 is hooked with the controller 46. The connector pin 22 is relatively thicker and covers the shaft 62 via an isolator 34. The isolator 34 is made with for example plastic for safety reasons. The isolator 34 is assembled with the connector pin 22 with for example interference-fit. The isolator 34 holds the shaft 62 with either friction or engagement of cogs. Thus, the adjusting function can be realized by turning the connector pin 22 together with the isolator 34 and in the meantime, driving the rotation of the shaft 62 of the rotary adjustment knob 48.

The free end of the leaf spring 35 contacts the cylindrical sidewall of the connector pin 22 to ensure the electrical connection between the connector pin and the PCB 50 during the rotation of the connector pin 22.

Figure 12:
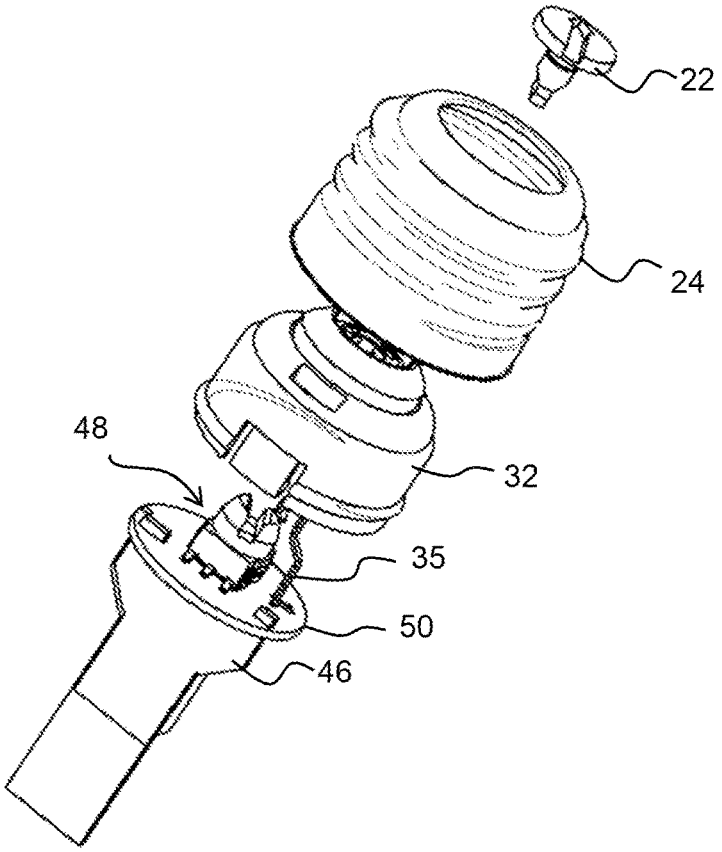
FIG. 12 shows an exploded view of a screw type bulb cap (together with the driver portion) in accordance with yet another example of the invention.
Figure 13:
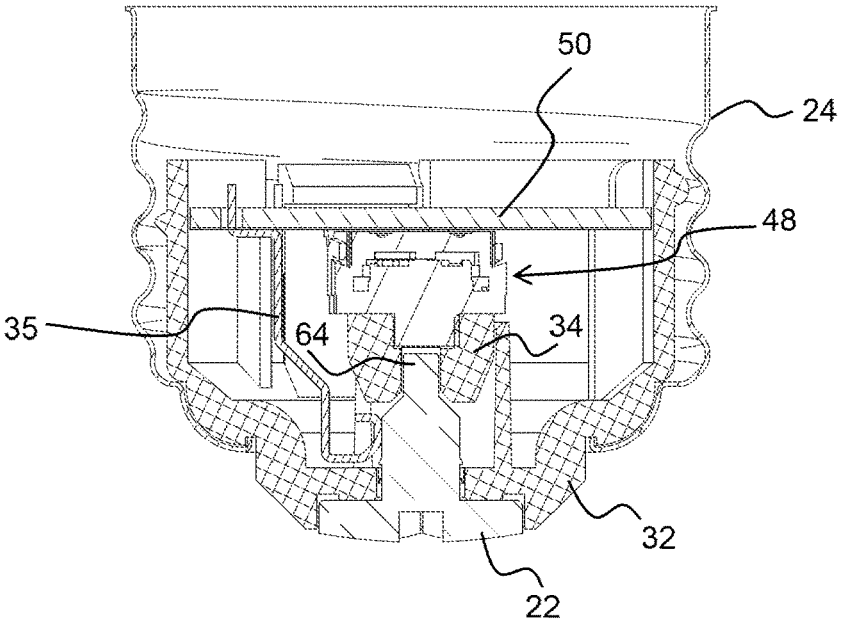
FIG. 13 shows a sectional view of the bulb cap of FIG. 12.

In the example shown in FIG. 12 and FIG. 13, the difference over above example is that, the connector pin 22 is thinner and has a projection 64 on its tip portion. This projection 64 is inserted into an adjustment slot on the rotary adjustment knob 48 to realize the adjusting function.

The examples above are based on a screw cap fitting. However, the invention may be applied to other types of electrical plug and socket.

Figure 8:
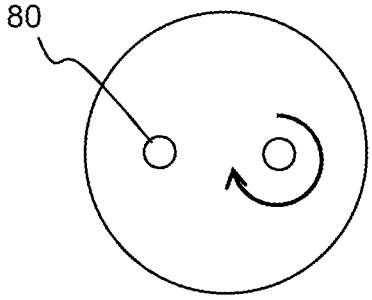
FIG. 8 shows a first example of a tubular lamp end connector.
Figure 9:
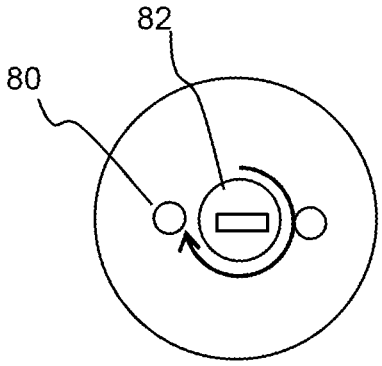
FIG. 9 shows a second example of a tubular lamp end connector.

FIGS. 8 and 9 show two examples of a tubular lamp end connector, comprising a pair of projecting pins 80.

In the example of FIG. 8, one of the pins is rotatable to implement adjustment of the controller settings. Of course, both pins may be rotatable to provide two different adjustment options.

In the example of FIG. 9, an additional manual adjustment element 82 is provided between the pins. The lighting unit may thus comprise a bulb or a tubular lamp. Indeed any bulb type or lamp type may be modified to provide the adjustment feature by incorporating an adjustment element at the connector interface where the bulb or lamp connects to external power.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The mere fact that certain measures are recited in mutually different dependent claims does not indicate that a combination of these measures cannot be used to advantage.

If the term "adapted to" is used in the claims or description, it is noted the term "adapted to" is intended to be equivalent to the term "configured to".

Any reference signs in the claims should not be construed as limiting the scope.

The invention claimed is:

1. A lighting unit comprising:

an outer housing;

a light source within the outer housing;

a controller within the outer housing for controlling the light source; and an external connector interface for connecting the lighting unit to an external source of power, wherein the external connector interface comprises a manual adjustment element having at least rotatable connector pin for selecting a setting of the controller and wherein the manual adjustment element is inaccessible when the lighting unit is connected to the external source of power.

2. The lighting unit of claim 1, comprising a bulb or a tubular lamp.

3. The lighting unit of claim 1, wherein the connector pin is rotatable between at least two positions corresponding to different settings of the controller.

4. The lighting unit of claim 1, wherein the external connector interface further comprises a screw connector wherein the screw connector includes the at least one connector pin as a central connector pin and having a surrounding thread connector.

5. The lighting unit of claim 4, comprising a metal intermediate part electrically contacts a power supply terminal of the controller and the connector pin mechanically couples to a switch of the controller for selecting the setting of the controller.

6. The lighting unit of claim 5, wherein the metal intermediate part is a metal intermediate ring in which the connector pin is rotatably received.

7. The lighting unit of claim 5, wherein the metal intermediate part is a leaf spring with which the connector pin is rotatably contacted.

8. The lighting unit of claim 5, wherein the switch of the controller comprises a rotary adjustment knob which is engaged by a rear part of the connector pin.

9. The lighting unit of claim 5, wherein the connector pin has a screw driver slot on a front part which is exposed to the outside of the lighting unit.

10. The lighting unit of claim 6, comprising a plastic over-molded ring between the connector pin and the thread connector, wherein the metal intermediate ring is fixed in position by the over-molded ring.

11. The lighting unit of claim 1, wherein the setting of the controller comprises a white color temperature setting.

12. The lighting unit of claim 11, wherein the setting of the controller comprises a warm white color temperature setting and a cool white color temperature setting.

13. The lighting unit of claims 1, wherein the setting of the controller comprises a brightness setting or a color setting.

14. The lighting unit of claims 1, wherein the setting of the controller comprises a beam shape setting.

15. The lighting unit of claim 1, wherein the light source comprises an LED arrangement and the controller comprises a LED driver.

* * * * *